United States Patent [19]

Slysh et al.

[11] 4,151,872

[45] May 1, 1979

[54] PANEL DEPLOYMENT SYSTEM

[75] Inventors: Paul Slysh; LeRoy E. Siden, both of San Diego, Calif.

[73] Assignee: General Dynamics Corporation, San Diego, Calif.

[21] Appl. No.: 863,036

[22] Filed: Dec. 21, 1977

[51] Int. Cl.[2] ..... E06B 3/32

[52] U.S. Cl. ..... 160/213; 244/173

[58] Field of Search ..... 160/130, 188, 213; 244/173

[56] References Cited

U.S. PATENT DOCUMENTS

| | | | |
|---|---|---|---|
| 3,477,662 | 11/1969 | Anderson | 244/173 |
| 3,532,299 | 10/1970 | Williamson et al. | 244/173 |
| 3,627,585 | 12/1971 | Dollery et al. | 244/173 |
| 3,677,508 | 7/1972 | Dillard et al. | 244/173 |
| 4,015,653 | 4/1977 | Slysh et al. | 160/213 |

*Primary Examiner*—Peter M. Caun

*Attorney, Agent, or Firm*—John R. Duncan

[57] ABSTRACT

A mechanism for deploying and retracting an isogrid structure particularly suited for use in supporting low weight reflective or absorbtive surfaces, characterized by a plurality of hinged isogrid panels stowed in an accordion folded stack arranged for automatic deployment into a long continuous strip or array. Two deployment arms in contact with the stack of panels are rotated to a position perpendicular to the stack, carrying with them a perforated deployment tape that is attached to the first panel. The tape is engaged to sprocket drives which draw the first panel from the stack. Thereafter, the panels are extended by the powered sprockets which engage perforations in the panel edges. A shutter sequentially releases pairs of panels during deployment. For retraction, the sprockets drive the panels back toward the stack where a creaser arm hinges pairs of panels which are thereafter folded into a stack by means of the shutter capturing and stowing each folded pair of panels.

5 Claims, 22 Drawing Figures

PANEL DEPLOYMENT SYSTEM

BACKGROUND OF THE INVENTION

A wide variety of mechanisms have been utilized to deploy panels from a storage container into some desired geometric patterned panel or array. Typically, such systems are used to deploy radio or radar antennas, solar-cell panel arrays for space craft, solar reflectors, etc. Some existing mechanisms for example utilize telescoping booms of circular or rectangular cross-section which support a flexible panel stored on a drum, and as the drum unwinds the panel is deployed between the two telescoping booms in a window shade manner.

Another mechanism utilizes telescoping booms and stores the panel in an accordion folded pack, deploying the panel between the booms in a similar manner to accordion pleated household drapes being drawn across a window. Other systems use inflatable booms or structures to support an array. In another, accordion folded panels are deployed by applying torque to each of the many panel hinges by means of a run-around cable and pulley system having drums located at each hinge point. In such arrangements, the panels are only coplanar upon full deployment, and should the system jamb during deployment the panels would be in a zig-zag patterned array. An exception is the earlier described drum deployment system which would have a portion of the window shade array deployed coplanar and usable should the deployment not be totally completed.

Many mechanisms and apparatus for actuating these systems utilize complex and heavy scissor arms, while others use springs for powering the deployment. Springs are heavy for the amount of power they supply, and additionally they do not provide the capability of retracting and restowing the array. In order to control the rate of deployment, dash pots are used in conjunction with the springs on some systems, thus reducing even more the power efficiency of the springs.

At least one of the inflatable structures utilizes a thermal setting resin to reinforce the structure and give it a permanent set once it has been deployed, and in still another refinement there is a metallizing of the inflatable structure after deployment. Clearly such systems are not capable of retraction and restowing.

A device having a deployment and retraction system overcoming the previously described limitations was disclosed in our U.S. Pat. No. 4,015,653, issued Apr. 5, 1977. Disclosed in said patent was a deployable structure having a foldable panel strip comprised of a plurality of rectangular panels hinged edge-to-edge in such a way that the panels could be folded in accordion fashion to provide a flat stack of minimum stowage volume. The invention utilized panels that optimized the cantilever and torsional mass stiffness properties of the system by employing lighter first-deployed panels than the last-deployed panels, eliminated reliance on spring energy and force balances, and employed a fully positive, fully engaged deployment mechanism.

The deployment mechanism utilized two deployment arms, each arm hinged at one end to the stowage compartment and having a second hinge partway along its length to permit folding it into a stowable length. A crawler, fitted around the outside diameter of each deployment arm in a telescoping manner, moved along the full length of the deployment arm by means of motor driven pinions engaging a rack on the deployment arm. The crawler carried the first panel with it as the crawler traversed the length of the deployment arm. Subsequent deployment of panels was accomplished by a second set of motor driven sprockets mounted on the crawler and engaged in perforations along the edges of each panel, the deployed strip comprised of a plurality of panels advancing much like a film strip in a movie projector.

To retract the deployed strip, a creaser bar extending across the bottom of the strip in a lateral direction under the hinge line of two adjoining panels was raised to jack-knife this pair of panels sufficiently to permit the panel edge engaged sprockets to drive the next pair of panels toward the creaser bar, and in so doing cause the jack-knifed pair of panels to fold compactly together in a back-to-back position in front of the stowage container. A shutter was utilized to capture each pair of folded panels and move them into the container where they were retained by a convoluted snake spring.

The panel driving sprockets were powered by electric motors connected to the sprockets by means of slip clutches, and shaft encoders were employed to obtain relative positions of the mechanisms for processing by flip-fiop logic to properly sequence the operations of the creaser and shutter relative to panel positions.

SUMMARY OF THE INVENTION

The present invention is an improvement in the deployment mechanism of our earlier invention disclosed in U.S. Pat. No. 4,015,653, issued Apr. 5, 1977. The deployment system herein disclosed comprises fewer elements, a reduction in size of some elements, and reduction in the number of mechanical movements to obtain a lighter weight system having increased reliability.

The improved deployment system is utilized on a deployable structure having a foldable panel strip comprised of a plurality of rectangular panels hinged edge-to-edge in such a way that the panels may be folded in accordion fashion to provide a flat stack of minimum stowage volume. Each panel is biased to assume curvature in a plane lateral to the deployment direction to stiffen the deployed strip. In the stowed position each panel is forced into a substantially flat contour, the spring action of each panel helping to restrain movement of the panel stack in the stowage container during transportation and assisting in removal of the panels from the container during the deployment mode.

In the present invention, the deployment arm crawlers, crawler drive motors and sprockets, and deployment arm racks have been eliminated. Additionally, the deployment arms have been reduced approximately one-third in length. This is accomplished by attaching a thin deployment tape to the first panel and engaging this tape in the panel deployment sprocket drive. First actuation of the sprocket drive causes the tape to remove the first pair of panels from the stowage container. Thus, the deployment arms must only be long enough to support two panels instead of three as previously disclosed in our earlier patent. This reduced length of the deployment arms allows them to be hinged to the stowage container at full length, thereby eliminating a second hinge which was earlier required to fold them into a stowable length.

It has been found unnecessary to employ a creaser bar that extends laterally across most of the width of the deployed panels. Creasing is efficiently accomplished by properly imposing a creasing force only at the outer edge hinges of the panel by the use of a creaser arm located at each of the two edges of the panel. No creaser bar connected at each end to the arms is used. Thus, a significant weight reduction has been realized in the creasing device.

The snake spring previously employed to retain the panels within the stowage compartment have been eliminated. This reduces the power requirements of the shutter by eliminating the task of passing pairs of panels over a plurality of lobes of the snake springs. Additionally, power requirements are reduced by reducing the moment arm of the shutter and employing a two-motion shutter in lieu of the single rotational sweep motion of the earlier invention. In the present invention, rotational movement of the shutter is only employed to capture a pair of panels, and linear movement of the shutter is employed to slide each pair of panels into their stowed position.

Stepping motors are used in the present invention to drive the shutter, creaser, and deployment arm drives, and slipping clutches and shaft encoders have been eliminated from the system.

The above described features and others will be hereinafter described in more detail so that a clearer understanding of the new and improved deployment system may be realized.

BRIEF DESCRIPTION OF THE DRAWINGS

The advantages of the present invention, which will subsequently become apparent, reside in the construction and operation as hereinafter described, reference being made to the accompanying drawings showing the preferred embodiment of the invention, wherein.

DETAILED DESCRIPTION OF THE INVENTION

Figure 1:
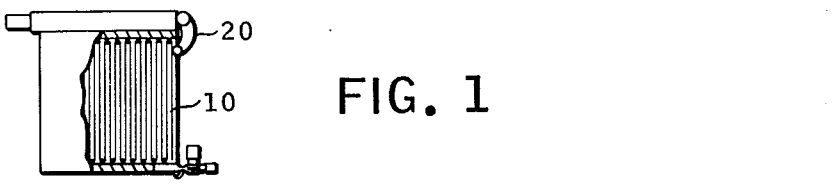
FIGS. 1 through 4 are schematic presentations of the sequential steps of deploying the panels.
Figure 2:
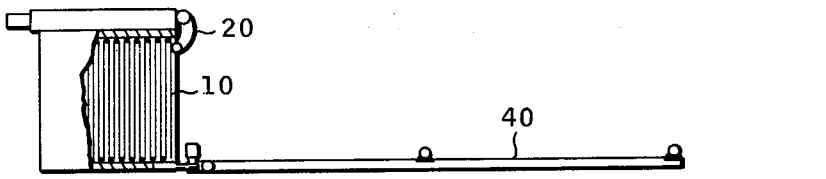

Referring now to the drawings in detail, FIG. 1 illustrates schematically a side view of the system in the stowed position. A plurality of panels 10, are folded in an accordion fashion and retained in this position by the shutter 20. In FIG. 2, the deployment arms 40 have been rotated to open positions.

Figure 3:
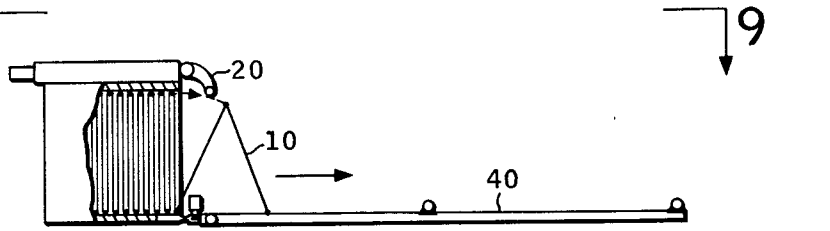
Figure 4:
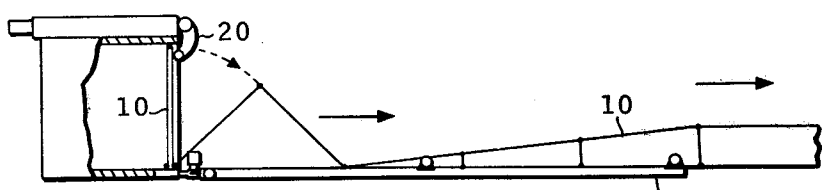

In FIG. 3, the deployment arms 40 are rotated outward to the open position and the deployment tape is pulling the first pair of panels from the stack. In FIG. 4, the first pair of panels 10 were drawn from a jack-knife position into a horizontal position between the deployment arms 40 and engaged in the sprockets as discussed below. The sprockets drove these first panels beyond the deployment arms 40, where the panels assumed their full biased curvature. It will be seen that additional panels 10 have been deployed and are being supported in a cantilever manner by deployment arms 40. These panels were deployed by means of sprocket drives located on the deployment arms 40. The sprockets engage slots located along the edge of the panels, and rotation of the sprockets extends the panels in a manner similar to a motion picture projector drive arrangement.

It is noted that the description and illustrations of these operations has been extremely brief and simplified, and parts have been eliminated in the illustrations in order that an overall understanding of the invention may be had before a more detailed disclosure is undertaken. In a like manner, a brief description of the retraction cycle will be made before the invention is fully disclosed.

Figure 5:
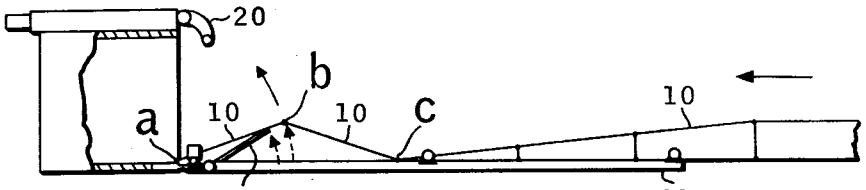
FIGS. 5 through 8 are schematic presentations of the sequential steps of retracting the panels.

In FIG. 5, the sprocket drives have been actuated in the retraction mode, and the creaser arm 30 has rotated upward, displacing the last two deployed panels of the array into a jack-knife position. The shutter 20 is in the open position.

Figure 6:
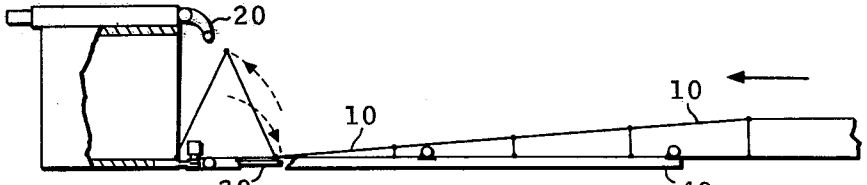
Figure 7:
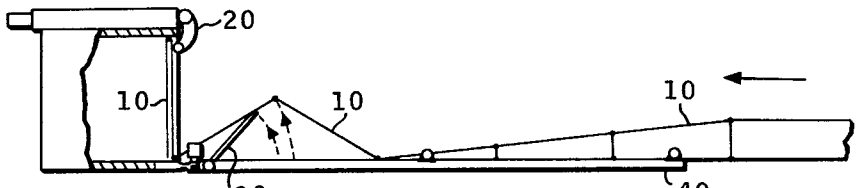
Figure 8:
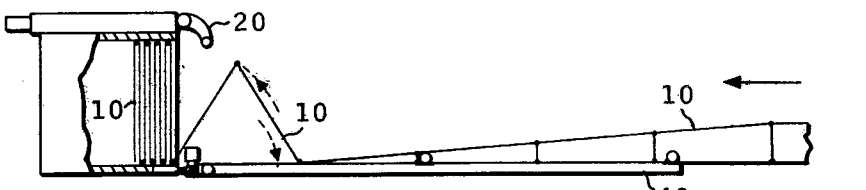

In FIG. 6, the creaser arm 30 has rotated downward while the sprocket drives located in the deployment arms 40 have continued to move the plurality of panels toward the stowed position causing the pair of panels to assume a jack-knife position of ever decreasing included angle. When this pair of jack-knifed panels has progressed sufficiently, the shutter 20 rotates, as shown in FIG. 7, and pushes the pair of panels into the fully accordion folded stowed position while creaser arm 30 begins to jack-knife another set of panels. The shutter 20 then rotates to the open position, and the creaser arm 30 rotates downward, as shown in FIG. 8, and the sequence shown in FIGS. 5 through 8 is repeated over and over again.

Figure 9:
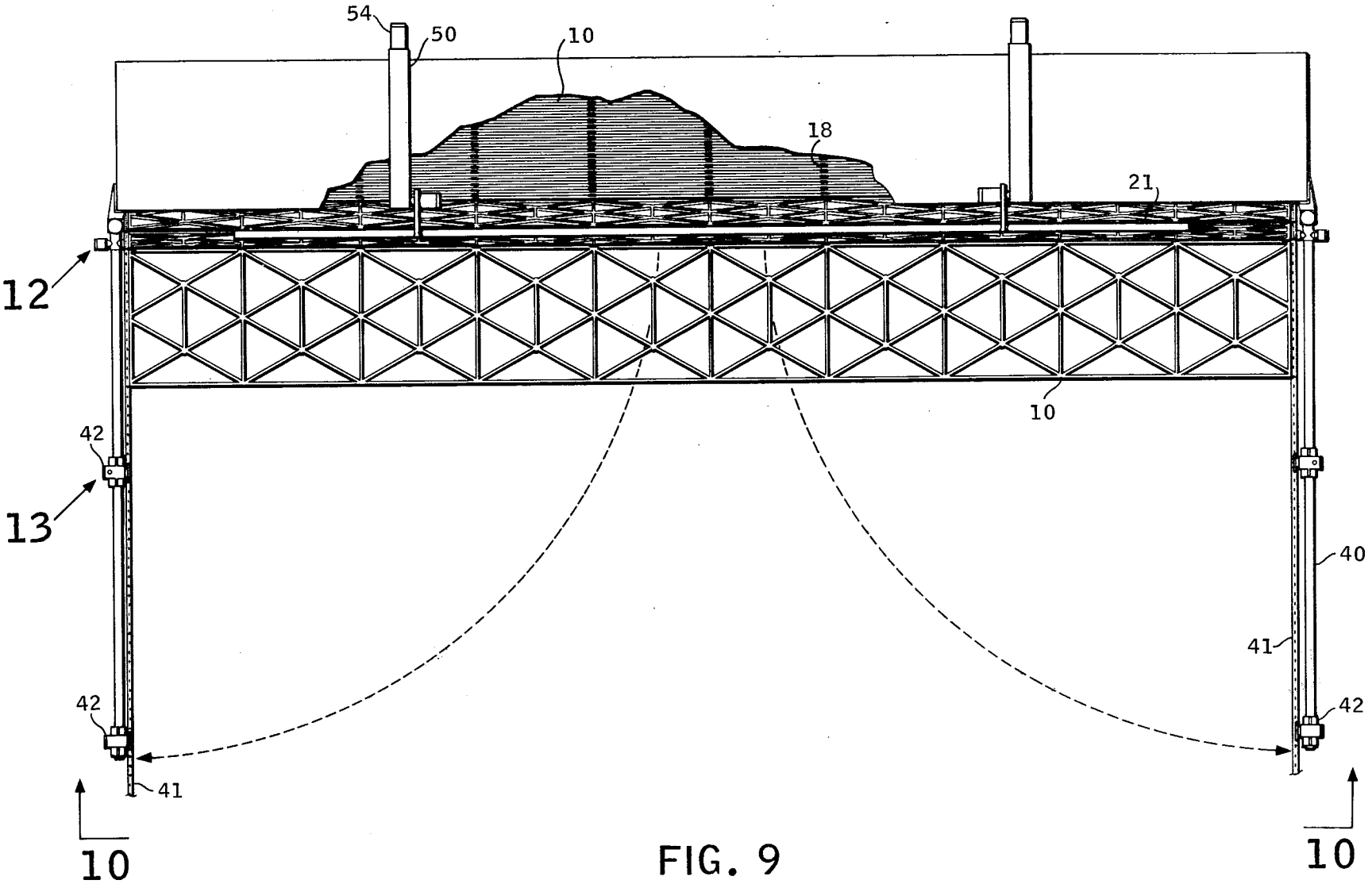
FIG. 9 is a plan view showing the general arrangement of the system.
Figure 10:
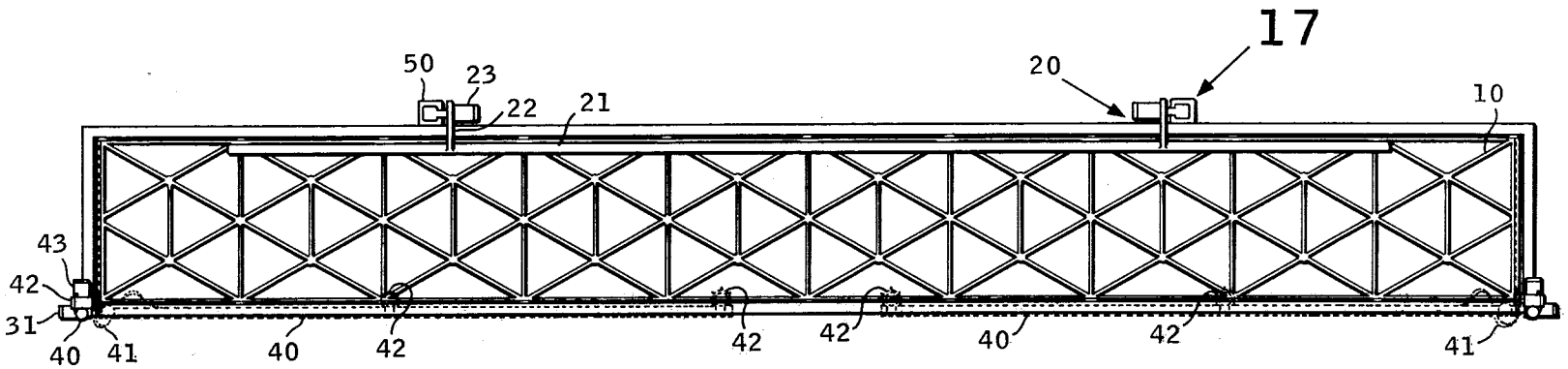
FIG. 10 is a front elevation view showing the general arrangement of the system.
Figure 11:
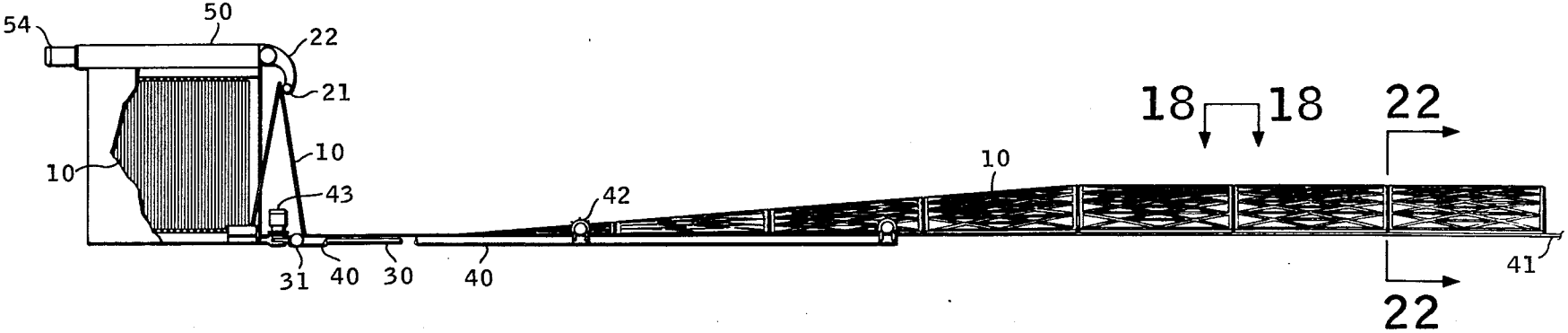
FIG. 11 is a side elevation view taken substantially from the left side as seen in FIG. 10.

Referring now to FIGS. 9, 10, and 11, wherein a plurality of panels 10 are stacked in the flat folded position, it will be noted that shutter 20 is retaining the panels in the stack. Shutter 20 comprises a shutter bar 21 attached near each end to shutter arms 22 which are rotated by a motor 23 and are rotatably attached to a shutter displacement drive 50, to be later described. The deployment arms 40 are disposed along the bottom edge of the panel stack and are hingedly attached to support structure so that they may rotate outwardly in a horizontal plane until positioned at substantially 90° to the stowed stack of panels.

A creaser arm 30 is pivotally attached to each deployment arm 40 near the deployment arm hinge. The creaser arm 30 is substantially in the horizontal plane of the deployment arms. Sprocket drives 42 are disposed at two locations on each of the deployment arms 40 and are engaged in deployment tape 41 which is attached to the lower edge of the first stowed panel 10.

Figure 12:
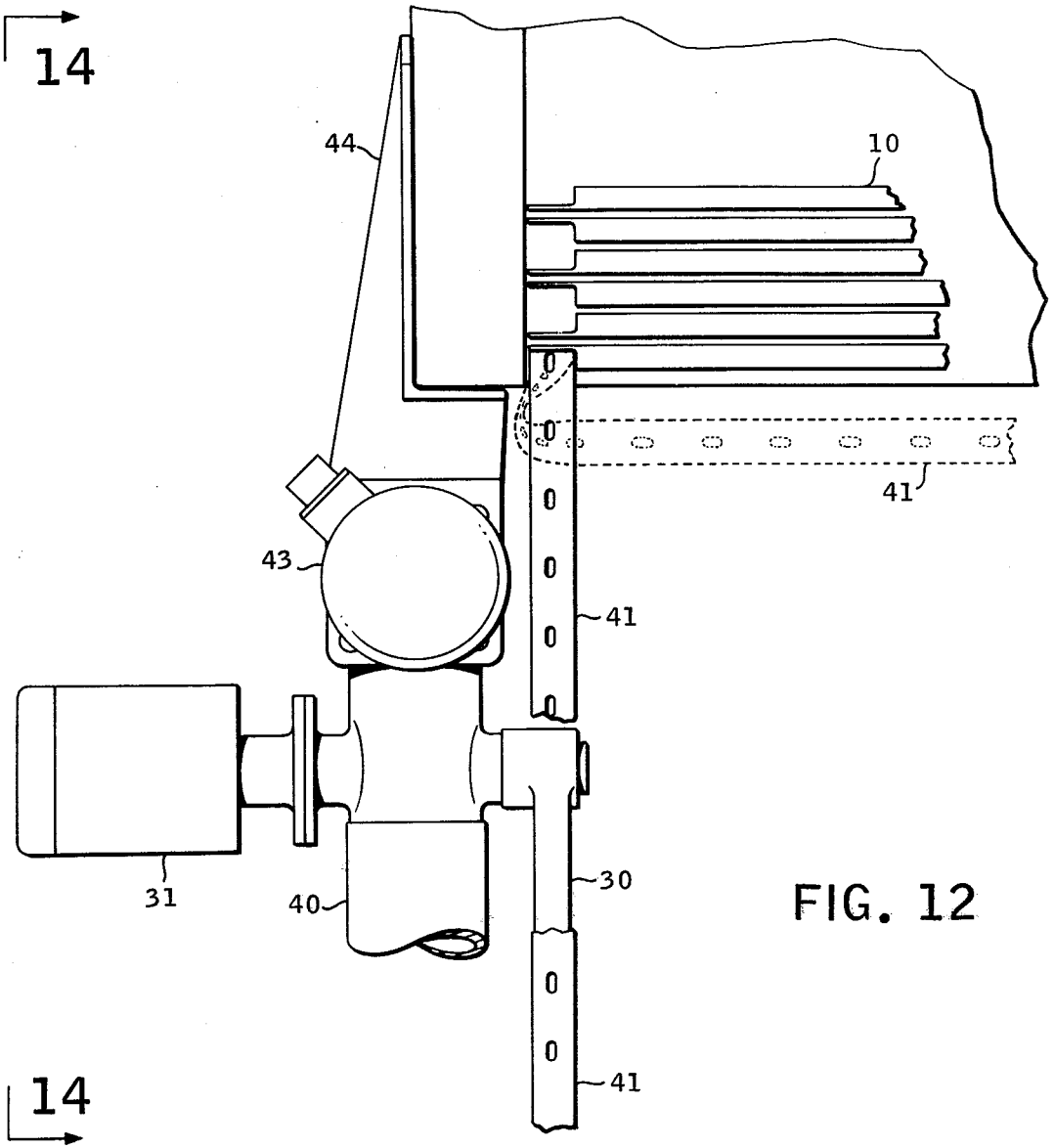
FIG. 12 is a detail plan view of one of the deployment arms as seen in FIG. 11.
Figure 14:
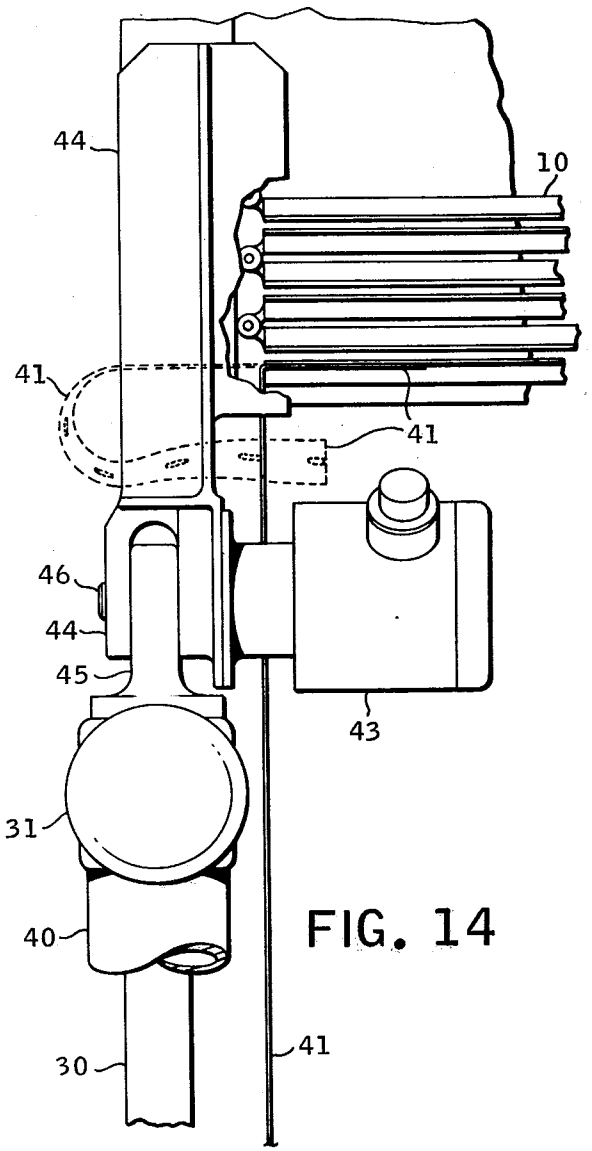
FIG. 14 is a side view of the deployment arm taken substantially from a plane indicated by line 14—14 in FIG. 12.

FIGS. 12 and 14 show the deployment arm hinge and creaser arm pivot in greater detail. Deployment arm 40 is hinged to clevis fitting 44 by means of tongue 45 rotating with splined shaft 46 which is fixed to the mating splined hole in tongue 45. The deployment arm drive motor 43 rotates the shaft 46. Pivotally mounted to deployment arm 40 is creaser arm 30, which is rotated by creaser arm drive motor 31. The two motors 31 and 43, as well as other motors in this device, are stepping motors, which function in a series of small angular displacements in which each displacement is caused by application of a d.c. signal. Stepping motors are available with as many as several hundred steps per revolution. Stepping of the motor is done by polarity switching of the stator poles, which may be as high as 1,000 or more steps per second. The circuitry and memory logic for stepping these motors is well known to those skilled in the art and, therefore, for clarity of the drawings is not illustrated herein.

Figure 15:
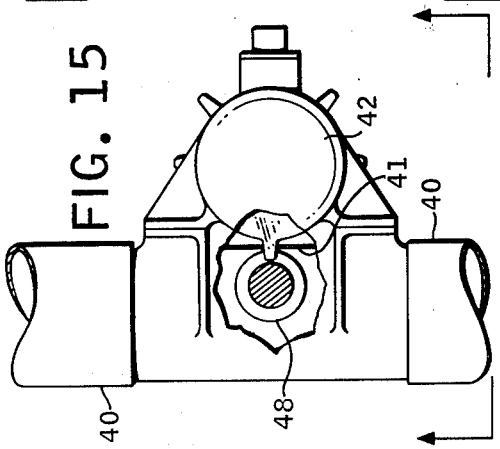
FIG. 15 is a side view of the panel drive mounted on the deployment arm taken substantially from a plane indicated by line 15—15 in FIG. 13.
Figure 16:
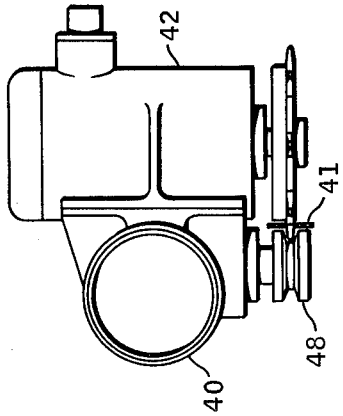
FIG. 16 is a sectional end view of the deployment arm taken through a plane indicated by section line 16—16 in FIG. 15.

FIG. 15 and 16 illustrate one of the sprocket drives 42, which in the stowed position engages the perforated deployment tape 41. As the sprocket rotates it advances the tape 41 which is attached to the lower portion of the first panel 10. The panel 10 is withdrawn from the stack and advances until it engages the sprocket. An outstanding lip on each end of the panel is shaped and perforated in substantially the same manner as the deployment tape 41, and it is by means of the panel lip engaging the sprocket drive 42 that each subsequent panel is deployed. To maintain engagement of the deployment tape and panel edges with the sprocket a grooved roller 48 is disposed near the sprocket and rotatably mounted to the deployment arm 40.

Figure 17:
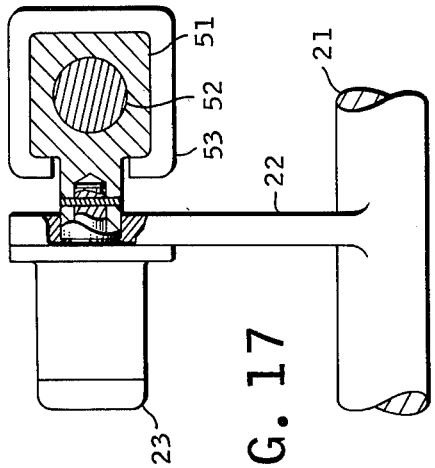
FIG. 17 is a front view of a shutter arm device taken from a plane indicated by line 17—17 in FIG. 11.

FIG. 17 is a detailed view of the shutter displacement drive 50. A translating nut 51 having a tapped hole for engaging threaded shaft 52 is slidably mounted within channel 53. The threaded shaft 52 is driven by stepping motor 54 (FIG. 11). During the extending mode the shutter arms 22 are rotated up to the open position by stepping motor 23 sufficiently to allow a pair of folded panels to pass by the shutter bar 21. The shutter arms 22 then rotate down to the closed position to retain the remainder of the stack. This action is repeated over and over, the shutter acting as an escapement device to allow only one pair of panels to unfold at a time. At the same time that the shutter arms 22 rotate to the open position the stepping motor 54 rotates the threaded shaft 52 sufficiently to displace traveling nut 51 on the threaded shaft a distance approximately equal to the thickness of one pair of panels. Thus, with each opening and closing of the shutter, the shutter moves toward the back of the stowage container a distance equal to the thickness of the panels allowed to "escape" from the stowage container to maintain the remaining panels in a closely stacked arrangement in the stowage container.

During the retraction mode the displacement drive 50 may be programmed to work in one of two methods. In the first method, the shutter 20 is positioned at the front of the stowage container as shown in FIG. 11. Each time the shutter opens and permits a pair of panels to return to the stowage container and then subsequently closes, the displacement drive 50 moves the shutter into the stowage container the distance displaced by one pair of stowed panels and then returns the shutter to the front of the container to await the next approaching pair of panels. In this method, the displacement drive moves the accumulated stack within the container a distance sufficient to allow the next pair of panels to enter the container. Thus, when the last pair of panels approach the stowed position, the displacement drive must move the entire stack into the final stowed position.

In the second method, the shutter is again positioned at the front of the container and after closing on the first pair of retracting panels the shutter is moved by the displacement drive to the rearmost position of the stowage container, thus stowing the first pair of retracted panels at the rear of the container. The displacement drive 50 must move the shutter 20 at a speed in unison with the speed that sprocket drives 42 are moving subsequent panels so that the shutter-captured panels do not start unfolding. The shutter 20 is then returned to the front of the container by the displacement drive 50 to await the next approaching pair of panels. On each subsequent cycle the shuttle 20 is displaced by drive 50 sufficiently to position each pair of panels firmly against the mounting stack of panels.

With the first method, a single repeated program of the displacement drive is utilized. The disadvantage is that the drive must have sufficient power to move the entire stack of panels. With the second method, the displacement drive must only be sufficiently powered to move one pair of panels; however, the disadvantage is that each cycle requires a different programming of the distance the shuttle moves into the container. The displacement speed must also be coordinated with the sprocket drives 42. Each method is suitable for certain applications. However, to gain the object of lightest weight, the second is the preferred embodiment.

Figure 21:
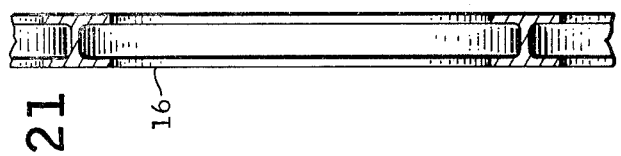
FIG. 21 is a sectional view of a panel node taken through a plane indicated by section line 21—21 in FIG. 18.
Figure 18:
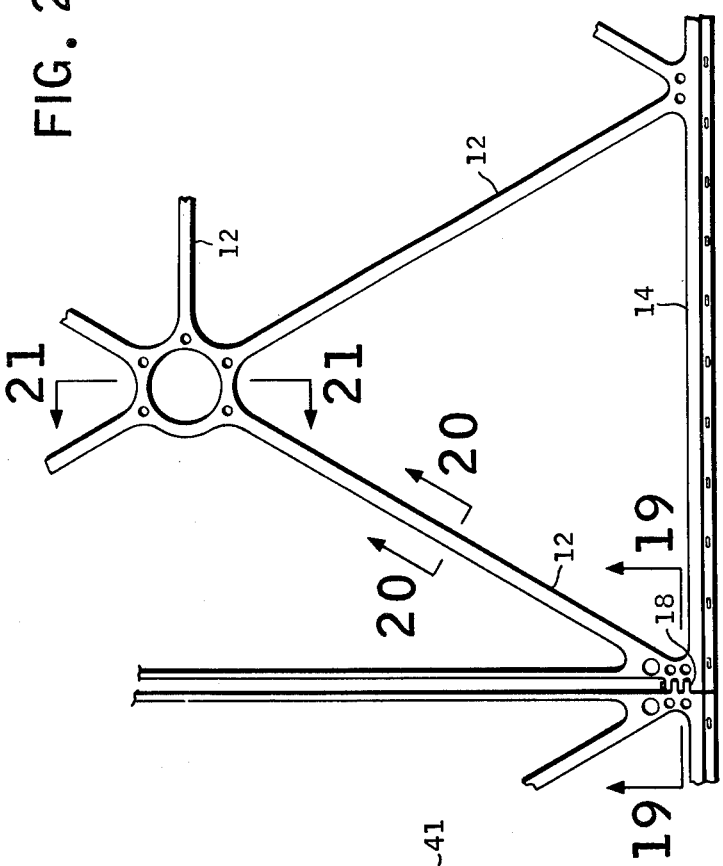
FIG. 18 is an enlarged plan view of a portion of two isogrid panels at the area in which they are hinged.
Figure 20:
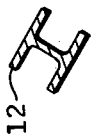
FIG. 20 is a sectional view through a structural grid member of the panel indicated by section line 20—20 in FIG. 18.

Referring now to FIGS. 9 and 18, it will be observed that panel 10 is an extremely light isogrid structure comprised of a plurality of grid members 12 arranged in a pattern of contiguous isosceles triangles and joined at their corners by circular nodes 16. A cross-section of a grid member 12 is shown in FIG. 20, and a cross-section of a node 16 is shown in FIG. 21. It should be appreciated that for some structural applications the cross-section of grid members 12 may be an I section, Z section, or a channel section, as may be required to support whatever surface is mounted thereon; however, the I section illustrated in FIG. 20 is the preferred section for symmetrical stiffness and spring constant properties in the plane of the panel. Certainly in most instances at least one web and one cap is desired, such as a T section. This panel structure is adaptable to supporting a solar panel substrate on which solar cells are mounted, for supporting light reflective or radio frequency reflective materials, or other desired surface material. The preferred section for edge member 14 is a channel section with an upstanding perforated lip for engaging sprocket drives 42.

Weight of this open isogrid structure is a function of grid member thicknesses and node-to-node spacing, and in most cases the structural strengths and stiffnesses compare superior, as do weights, to honeycomb sandwich construction usually employed for such applications. Where extremely light structures are required, isogrid panels have been produced from aluminum alloy where the wall thickness of grid members 12 were 0.004 inch. The grids were first machined to a wall thickness of 0.050 inch and then chemically milled to the required 0.004 inch thickness. As an example of the extreme lightness of this open isogrid structure, a panel having sixteen inch node-to-node spacing, a 0.25 inch panel thickness and grid widths, and wall thicknesses of 0.004, weighs about 0.01 pounds per square foot, or 100 square feet would weigh approximately one pound.

Figure 22:
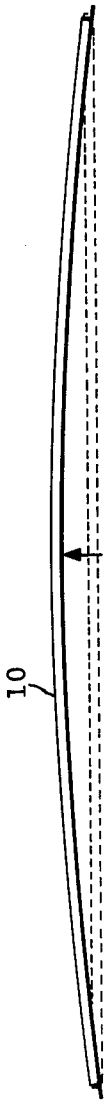
FIG. 22 is a sectional end view taken through one of the panels in a plane indicated by line 22—22 in FIG. 11.
Figure 13:
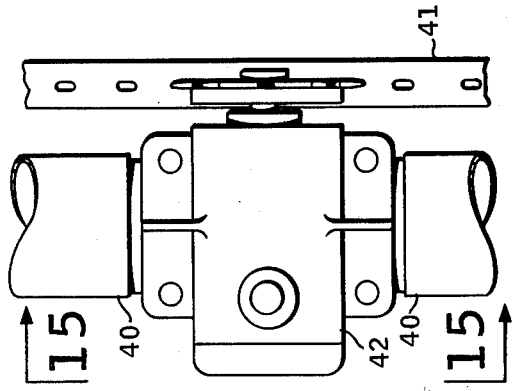
FIG. 13 is a detail plan view of the panel drive mounted on the deployment arm.
Figure 19:
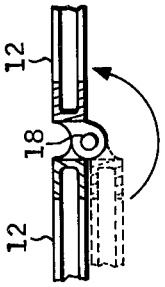
FIG. 19 is a sectional view of a panel hinge taken substantially through a plane indicated by section line 19—19 in FIG. 18.

Hinge fittings 18 are located along each of two opposite edges of panels 10 at the intersections of grid members 12 and are adapted to provide at least 180° relative movement between panels, as shown in FIG. 19. The panels 10 are hinged together by means of these hinge fittings 18 to fold in alternate directions with respect to one another. When fully deployed, the panels lie in a common plane as shown in FIG. 11 and assume the cross-sectional curvature shown in FIG. 22, forming a structurally stable configuration similar to the extended carpenters steel tape. This performed curvature, giving each panel a leaf-spring characteristic, can only exist in a panel when it has become coplanar with other deployed panels. In the stowed position, this uni-directional curvature is fully removed by mutual reaction at hinges 18 between abutting panels. In the stowed position, the alternate folding of panels causes the unidirectional curvature preload in each pair of back-to-back panels to mutaully cancel out, and the hinge line is a straight line. It is only when this pair of panels rotate into a common plane that the hinge restraint is removed and the panels may assume a mutual curvature. Upon retraction, the creaser arm 30 rotates upward with sufficient force to overcome the curvature preload in the panels and again cause the hinge line to become straight. Upon the retraction of each pair of panels, the shutter bar 21 is rotated down and then displaced by drive 50 to push this pair of panels back into the stowage container until the pair of panels are flat against the previously stowed panels to form a flat stack as shown in FIG. 11.

As previously described herein, the motors utilized in the system may be stepping motors where the characteristics of a stepping motor are desired. Stepping motors may be utilized to perform as electrical ratches, so that within the holding torque capability of the motor a mechanism will not move except on signal from the programmer. This type motor produces precise intermittent angular motion from low level electrical signals, and commands for the motor motion are easily stored, as for example on magnetic tape. Switching signals may also be generated by a shaft operated switch, oscillator, photo cell circuit or other means that furnish on-off command signals, each signal advancing the motor one step.

This electrical ratchet function permits the elimination of slip clutches on the drive motors for preloading the mechanism. Also because of the ability to precisely position these stepping motors and for the programmer to know precisely where the motor shaft has been positioned, it is unnecessary to utilize shaft encoders as was previously done to obtain panel position input to the logic system in order to properly sequence creaser arm and shutter bar operations with the sprocket drive positioning of the panels. For example, when the array is being retracted, creasing causes rotation at three panel hinges simultaneously (hinge joints a, b, and c of FIG. 5). The programmer by directing each step of the sprocket drive rotation knows at what step number the crease farthest away from the stack (hinge joint c of FIG. 5) is approaching the stowed position and will initiate a cycle of the shutter bar 21 to capture the creased pair of panels and force them into their stowed position. When the creased panels have been stowed, and the panel sprocket drives are moving the next pair of panels in coordinated speed with the stowage operation, the programmer has signaled and monitored that the proper angular sweep and translation of shutter arm 22 has occurred, the programmer initiates a movement of the creaser arm 31 to recycle the panel folding and stowing process. In a similar manner during deployment, coordinated movements of the shutter 20 and the panel drive sprockets 42 cause the shutter 20 to cycle open and close to permit passage of one pair of panels at a time for subsequent deployment by the panel drive sprockets.

At the time a pair of panels was stowed and before the creaser has recycled, the holding torque of panel drive sprockets 42 induces counteracting moments on the deployed array to leave the array substantially undisturbed by the creasing process. This is understood by recognizing that the sprocket drive forces on the edges of the curved deployed panel array act with respect to the centroidal plane of the array to counteract the moment created by the creaser arms. It therefore is desirable that the sprocket drive electrical ratchet forces are present at the time the panels are being creased.

From the foregoing description, the operation of the disclosed system may be understood. The deployment arms 40 are rotated horizontally to open positions carrying the creaser arms 30 with them, this operation being accomplished by motor drive 43. The panel sprocket drives 42 are actuated drawing deployment tapes past the sprockets until the first panels engage the sprockets. Subsequent panels are deployed by coordinated movements of the shutter bar 21 and panel drive sprockets. To retract the deployed panels, the panel drive sprockets 42 are actuated in a reverse direction and the creaser arms 30 act to crease the two panels closest to the stowage volume. The sprocket drives now continue to retract the two panels, and when the upper crease is in reach of the shutter bar 21, the bar acts to capture the panels and force them into the back end of the stowage volume. When this is accomplished, the drive sprockets 42 are momentarily stopped until the creaser arms 30 crease the next pair of panels. Subsequent panel retractions are accomplished by repeating the cycle thus described.

The flexibility of the open isogrid structured panels 10 in the plane of the panel permits creasing action well within the elastic range of the panel material. The characteristics of isogrid structures for broad scale strain redistribution are used to insure no excessive local straining of whatever surface is mounted to the isogrid panels. Open isogrid structured panels allow larger back radiation from the surface mounted thereon than most other panel constructions, and the open structure permits access to the back side of the mounted surface for attaching components or for repair.

Low compliances with respect to forces in the plane of the panels are desirable to obtain maximum deployed structural rigidity; however, compliances must be adequate to insure that creasing forces to overcome hinge restraints do not yield the isogrid structure or excessively strain the solar cell substrate, reflective material, or other surface that may be carried by the isogrid structure.

The isogrid node-to-node spacing, grid cross-sections, node diameters and sprocket drive edge fixity are all variables that may be altered to obtain the desired performance for a particular sized panel structure and deployment mechanism. Other arrangements, modifications, and applications of the invention will become apparent to those skilled in the art upon reading the present disclosure, and these are intended to be included within the scope of the invention.

We claim:

1. An improved panel deployment system of the type wherein a plurality of panels are hingedly connected together in end-to-end relation and alternately folded into an accordion folded stack, said panels adapted for unfolding between two deployment arms and subsequently being extended beyond said arms to form an elongated array of a type which may later be sequentially creased and folded, one pair of panels at a time, to reform an accordion folded stack, wherein the improvement comprises:

deployment arms each functionally of one-piece construction having a maximum of one hinge, said hinge located at one end of each of said deployment arms;

panel driving sprockets located at fixed points on said deployment arms, wherein a maximum of two sprockets are located on each of said deployment arms for transporting said panels to and from said stack; and deployment tapes, each of said tapes connected at one end to an outer edge of the first of said panels and in mechanical engagement with at least one of said panel driving sprockets.

2. A panel deployment system according to claim 1 wherein each of said deployment arm lengths are less than two panel lengths.

3. A panel deployment system according to claim 1 further comprising a shutter rotatably mounted to a pivot point and adapted to rotate from a closed position to an open position and return to said closed position in such a manner that only one pair of folded panels at a time pass by said shutter, said pivot point adapted for linear movement toward and away from said accordion folded stack for retaining said stack in a compressed state each time said shutter is returned to said closed position.

4. A panel deployment system according to claim 1 further comprising panel creasing arms each having a free end and a rotatably fixed end attached to one of said deployment arms, each of said creasing arms mechanically independent in rotational movement from each other.

5. A panel deployment system according to claim 4 wherein said creasing arms are adapted at their free ends to contact only the outside edge area of said panels.

* * * * *